US009618272B2

(12) United States Patent
Kuang et al.

(10) Patent No.: US 9,618,272 B2
(45) Date of Patent: Apr. 11, 2017

(54) TEMPERATURE AND HUMIDITY INDEPENDENT CONTROL AIR CONDITIONING SYSTEM AND METHOD

(71) Applicant: Carrier Corporation, Farmington, CT (US)

(72) Inventors: YuHui Kuang, Shanghai (CN); Chungang Wang, District Shanghai (CN)

(73) Assignee: CARRIER CORPORATION, Farmington, CT (US)

( * ) Notice: Subject to any disclaimer, the term of this patent is extended or adjusted under 35 U.S.C. 154(b) by 786 days.

(21) Appl. No.: 13/938,559

(22) Filed: Jul. 10, 2013

(65) Prior Publication Data

US 2014/0014297 A1 Jan. 16, 2014

(30) Foreign Application Priority Data

Jul. 12, 2012 (CN) ..... 2012 1 0240576

(51) Int. Cl.
*F28D 15/00* (2006.01)
*F24F 11/00* (2006.01)

(52) U.S. Cl.
CPC ..... *F28D 15/00* (2013.01); *F24F 11/0008* (2013.01); *F24F 11/008* (2013.01); *F24F 2011/0075* (2013.01)

(58) Field of Classification Search
CPC ..... F24F 3/14; F24F 3/153; F24F 11/0015; F24F 2203/02; F24F 3/1405; F24F 2003/1446; F24F 11/0008; F25B 7/00; F28D 15/00
USPC ..... 165/225, 229
See application file for complete search history.

(56) References Cited

U.S. PATENT DOCUMENTS 4,274,264 A 6/1981 Andres
4,786,301 A * 11/1988 Rhodes ..... F24F 3/1411 62/271
4,876,858 A * 10/1989 Shaw ..... F24F 3/1405 62/199
4,942,740 A 7/1990 Shaw et al.
4,974,665 A * 12/1990 Zillner, Jr. ..... F24F 11/0009 165/229
5,325,676 A 7/1994 Meckler
(Continued)

FOREIGN PATENT DOCUMENTS

WO 9913277 A1 3/1999
WO 2004005808 1/2004
(Continued)

*Primary Examiner* — Devon Russell
(74) *Attorney, Agent, or Firm* — Cantor Colburn LLP

(57) ABSTRACT

This invention provides a temperature and humidity independent control air conditioning system, comprising a high temperature cooling unit, a low temperature cooling unit, a humidity processing unit, and an indoor unit, wherein the coolant with a first temperature provided by the high temperature cooling unit flows into the indoor unit and then its temperature becomes a second temperature; the coolant with a third temperature provided by the low temperature cooling unit flows into the humidity processing unit; the coolant with the second temperature is divided to the low temperature cooling unit. With this invention, temperature and humidity independent control can be realized with high efficiency.

13 Claims, 3 Drawing Sheets

(56) References Cited

U.S. PATENT DOCUMENTS 5,622,057 A * 4/1997 Bussjager ..... F24F 3/153 62/173
5,799,728 A * 9/1998 Blume ..... F24F 3/1405 165/231
6,036,746 A 3/2000 Scovazzo et al.
6,209,333 B1 4/2001 Bascobert
RE37,464 E 12/2001 Meckler
6,351,950 B1 3/2002 Duncan
6,427,454 B1 * 8/2002 West ..... F24F 3/153 62/176.1
6,430,947 B2 8/2002 Bascobert
6,578,375 B2 6/2003 Bascobert
6,607,029 B2 8/2003 Danieau
6,651,445 B1 11/2003 Clark et al.
6,658,874 B1 * 12/2003 Trent ..... F24F 3/153 165/298
6,705,093 B1 * 3/2004 Taras ..... F24F 3/153 62/238.6
6,775,996 B2 8/2004 Cowans
7,104,082 B1 9/2006 Moratalla
7,302,807 B2 * 12/2007 Yakumaru ..... B60H 1/00878 62/196.3
7,469,555 B2 * 12/2008 Taras ..... F24F 3/153 62/510
7,559,207 B2 * 7/2009 Knight ..... F25B 49/027 62/115
7,721,560 B2 5/2010 Carpenter
7,757,504 B2 * 7/2010 Yonezawa ..... F24F 11/001 236/44 C
7,779,639 B2 * 8/2010 Goenka ..... B60H 1/004 136/204
7,836,712 B2 * 11/2010 Sasao ..... F24F 11/0008 236/44 C
7,845,185 B2 * 12/2010 Knight ..... F24F 3/153 62/173
8,033,122 B2 * 10/2011 Bean, Jr. ..... F24F 3/1405 62/90
8,261,565 B2 * 9/2012 Borror ..... F25B 23/006 62/113
9,238,398 B2 * 1/2016 Lu ..... B60H 1/00592
2001/0025500 A1 10/2001 Bascobert
2005/0242201 A1 11/2005 Shorrock
2006/0021366 A1 * 2/2006 Plummer ..... B60H 1/323 62/236
2008/0173035 A1 * 7/2008 Thayer ..... F24F 3/153 62/173
2008/0315000 A1 * 12/2008 Gorthala ..... B60H 1/00785 236/46 C
2009/0201644 A1 * 8/2009 Kelley ..... H05K 7/20836 361/699
2010/0242507 A1 * 9/2010 Meckler ..... F24F 3/1423 62/94
2011/0016893 A1 * 1/2011 Dawes ..... F25B 49/02 62/89
2011/0018472 A1 1/2011 Rockenfeller et al.
2011/0056668 A1 * 3/2011 Taras ..... F28D 1/0478 165/174
2011/0114284 A1 * 5/2011 Siegenthaler ..... F25B 30/06 165/45
2012/0174607 A1 * 7/2012 Cur ..... F25B 25/00 62/186

FOREIGN PATENT DOCUMENTS

WO 2006014652 A2 2/2006
WO 2006050282 A2 5/2006
WO 2011009411 A1 1/2011

* cited by examiner

TEMPERATURE AND HUMIDITY INDEPENDENT CONTROL AIR CONDITIONING SYSTEM AND METHOD

CROSS-REFERENCE TO RELATED APPLICATIONS

This application is a non-provisional patent application which claims priority to Chinese Patent Application No. 201210240576.6 filed Jul. 12, 2012, the entire contents of which are incorporated herein by reference.

TECHNICAL FIELD OF THE INVENTION

The present invention relates to air conditioning, particularly to that controls temperature and humidity independently.

BACKGROUND OF THE INVENTION

Conventional air conditioning system controls temperature and humidity in combination. It realizes the control by changing the temperature and humidity of the air to be output into rooms. However, such system will lead to a poor performance of the cooling unit and a waste of energy grade because it deals with sensible and latent heat in the same time. Besides, such system can result in stagnant water and cause problems such as the propagation of mildew.

There are some relevant solutions available in the art. For example, U.S. Pat. No. 7,721,560 discloses a system for controlling temperature and humidity in an enclosure, that has a central air conditioning system; a dehumidifier attached to a return air duct of the central air conditioning system; and a system control that comprises a thermostat, dehumidstat and can control a cooling solenoid valve to provide temperature control, and control a dehumidifier solenoid valve to provide humidity control. The cooling solenoid valve and the dehumidifier solenoid valve can be independently activated based on the temperature and humidity of the enclosure.

U.S. Pat. No. 5,325,676 discloses s convertible desiccant assisted air pre-conditioner for implemented use to dehumidify an air column delivered into an air conditioned space, and including: a first ducting means dedicated to dehumidification of incoming air at an intake end and delivering supply air at a discharge end for conditioning said air conditioned space, a second ducting means dedicated to desiccant regeneration by means of return air from said air conditioned space, there being at least one air flow control means at an intake end of the second ducting means, a third ducting means for receiving return air at an intake end and delivering exhaust air at a discharge end, there being one air flow control means space at the intake end of the third ducting means and at least one air flow control means space at the discharge end of the third ducting means, a coupler means duct open between the at least one air flow control means at an intake end of the second ducting means and said one flow control means space at the intake end of the third ducting means, desiccant dehumidifying means exposed to an air column flowing through the first ducting means for dehumidification and exposed to an air column flowing through the second ducting means for regeneration of weakened desiccant, heater means for tempering the air column to a regenerating temperature through the second ducting means, and heat transfer means exposed to air columns flowing through each of said first and third ducting means.

However, it costs too much to build a conventional system because several parts need to be designed separately and it is difficult to adopt modular design. In addition, the conventional systems are not energy saving, and particularly they are not efficient in humidity control. Therefore, in an epoch that energy saving is highly advocated, a temperature and humidity independent control air conditioning system with low cost in building and running is expected.

SUMMARY OF THE INVENTION

To resolve at least one aspect of the above problems, this invention provide a temperature and humidity independent control air conditioning system, comprising: a high temperature cooling unit, a low temperature cooling unit, a humidity processing unit, and an indoor unit, wherein coolant with a first temperature provided by the high temperature cooling unit, after flowing into the indoor unit, becomes coolant with a second temperature, which flows back into the high temperature cooling unit; coolant with a third temperature provided by the low temperature cooling unit, after flowing into the humidity processing unit, becomes coolant with a fourth temperature, which flows back into the low temperature cooling unit; and the coolant with the second temperature is divided into the low temperature cooling unit to become coolant with a fifth temperature, which flows back into the high temperature cooling unit.

According to one aspect of the invention, in the temperature and humidity independent control air conditioning system, the coolant with the first temperature is divided into the humidity processing unit to become coolant with a sixth temperature, which flows back into the high temperature cooling unit.

According to one aspect of the invention, in the temperature and humidity independent control air conditioning system, the coolant with the second temperature is divided into a condenser of the low temperature cooling unit to become the coolant with the fifth temperature, which flows out of the condenser of the low temperature cooling unit.

According to one aspect of the invention, in the temperature and humidity independent control air conditioning system, the low temperature cooling unit is a water-to-water heat pump.

According to one aspect of the invention, the temperature and humidity independent control air conditioning system further comprises a control unit, which communicates with the high temperature cooling unit, the low temperature cooling unit, the humidity processing unit, and the indoor unit, and the control unit regulates the flow rate of the coolant provided by the high temperature cooling unit and the first temperature according to the indoor temperature requirement, and regulates the flow rate of the coolant provided by the low temperature cooling unit and the third temperature according to the indoor humidity requirement.

According to one aspect of the invention, the temperature and humidity independent control air conditioning system further comprises a control unit, which communicates with the high temperature cooling unit, the low temperature cooling unit, the humidity processing unit, and the indoor unit, and the control unit regulates the flow rate of the coolant provided by the high temperature cooling unit and the first temperature according to both the indoor temperature requirement and the indoor humidity requirement, and regulates the flow rate of the coolant provided by the low temperature cooling unit and the third temperature according to the indoor humidity requirement.

According to one aspect of the invention, in the temperature and humidity independent control air conditioning system, the humidity processing unit comprises a first coil and a second coil, and the coolant with the first temperature flows into the inlet of the first coil; the coolant with the sixth temperature flows out of the outlet of the first coil; the coolant with the third temperature flows into the inlet of the second coil; the coolant with the fourth temperature flows out of the outlet of the second coil.

According to one aspect of the invention, in the temperature and humidity independent control air conditioning system, the second coil is arranged downstream from the first coil in the flow direction of fresh air or return air which flows into the humidity processing unit.

According to one aspect of the invention, in the temperature and humidity independent control air conditioning system, in a cooling mode, the second temperature is higher than the first temperature, the fourth temperature is higher than the third temperature, and the fifth temperature is higher than the second temperature.

According to one aspect of the invention, in the temperature and humidity independent control air conditioning system, in a cooling mode, the second temperature is higher than the first temperature, the fourth temperature is higher than the third temperature, the fifth temperature is higher than the second temperature, and the sixth temperature is higher than the first temperature.

According to one aspect of the invention, in the temperature and humidity independent control air conditioning system, in a heating mode, the second temperature is lower than the first temperature, the fourth temperature is lower than the third temperature, and the fifth temperature is lower than the second temperature.

According to one aspect of the invention, in the temperature and humidity independent control air conditioning system, in a heating mode, the second temperature is lower than the first temperature, the fourth temperature is lower than the third temperature, the fifth temperature is lower than the second temperature, and the sixth temperature is lower than the first temperature.

This invention provides a temperature and humidity independent control air conditioning system, comprising: a high temperature cooling unit, a low temperature cooling unit, a humidity processing unit, and a indoor unit, wherein coolant with a first temperature provided by the high temperature cooling unit, after flowing into the indoor unit, becomes coolant with a second temperature, which flows back into the high temperature cooling unit; coolant with a third temperature provided by the low temperature cooling unit, after flowing into the humidity processing unit, becomes coolant with a fourth temperature, which flows back into the low temperature cooling unit; and the coolant with the first temperature is also divided into the low temperature cooling unit to become coolant with a sixth temperature, which flows back into the high temperature cooling unit.

According to one aspect of the invention, in the temperature and humidity independent control air conditioning system, in a cooling mode, the second temperature is higher than the first temperature, the fourth temperature is higher than the third temperature, and the sixth temperature is higher than the first temperature.

According to one aspect of the invention, in the temperature and humidity independent control air conditioning system, in a heating mode, the second temperature is lower than the first temperature, the fourth temperature is lower than the third temperature, and the sixth temperature is lower than the first temperature.

According to one aspect of the invention, in the temperature and humidity independent control air conditioning system, the low temperature cooling unit is an air-cooled chiller.

According to one aspect of the invention, the temperature and humidity independent control air conditioning system further comprises a control unit, which communicates with the high temperature cooling unit, the low temperature cooling unit, the humidity processing unit, and the indoor unit, and the control unit regulates the flow rate of the coolant provided by the high temperature cooling unit and the first temperature according to both the indoor temperature requirement and the indoor humidity requirement, and regulates the flow of the coolant provided by the low temperature cooling unit and the third temperature according to the indoor humidity requirement.

According to one aspect of the invention, in the temperature and humidity independent control air conditioning system, the humidity processing unit comprises a first coil and a second coil, the coolant with the first temperature flows into the inlet of the first coil, the coolant with the sixth temperature flows out of the outlet of the first coil; the coolant with the third temperature flows into the inlet of the second coil, the coolant with the fourth temperature flows out of the outlet of the second coil.

According to one aspect of the invention, in the temperature and humidity independent control air conditioning system, the second coil is arranged downstream from the first coil in the flow direction of fresh air or return air which flows into the humidity processing unit.

This invention provides a method of controlling a temperature and humidity independent control air conditioning system, comprising: controlling the flow rate of the coolant with the first temperature into the indoor unit and the first temperature, so as to adjust the indoor temperature; controlling the flow rate of the coolant with the third temperature into the humidity processing unit and the third temperature, so as to adjust the indoor humidity; and controlling the flow rate of the coolant with the second temperature divided into the low temperature cooling.

This invention provides a method of controlling a temperature and humidity independent control air conditioning system, comprising: controlling the flow rate of the coolant with first temperature into the indoor unit and the first temperature, so as to adjust the indoor temperature; controlling the flow rate of the coolant with third temperature into the humidity processing unit and the third temperature, so as to adjust the indoor humidity; and controlling the flow rate of the coolant with the first temperature divided into the humidity processing unit.

With the present invention, temperature and humidity independent control with high efficiency can be realized.

DESCRIPTION OF FIGURES

To facilitate understanding, non-limiting examples are described with reference to the following figures, wherein.

DETAILED DESCRIPTION OF THE INVENTION

Figure 1:
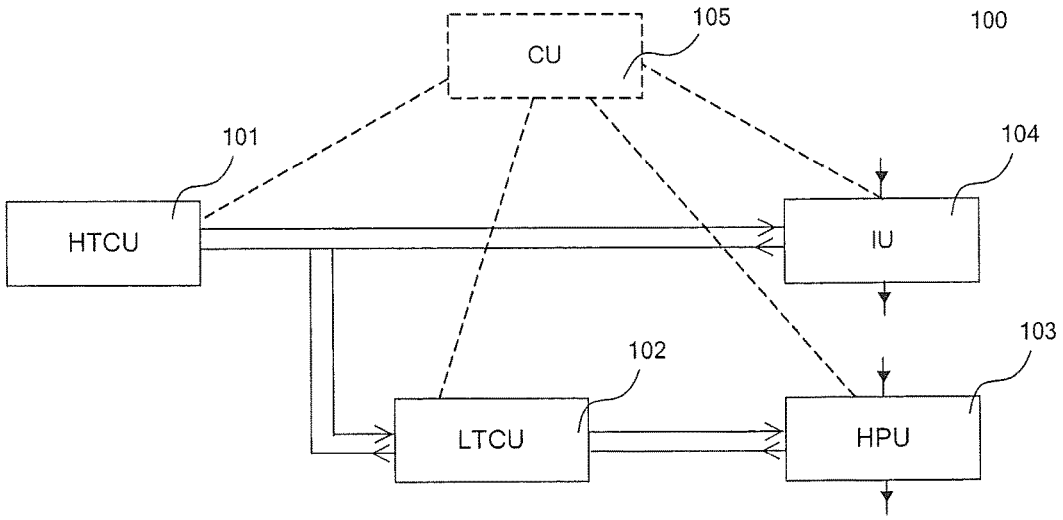
FIG. 1 illustrates a temperature and humidity independent control air conditioning system according to the present invention.

FIG. 1 illustrates an embodiment of the temperature and humidity independent control air conditioning system according to the present invention. The air conditioning system 100 comprises a high temperature cooling unit (HTCU) 101, a low temperature cooling unit (LTCU) 102, a humidity processing unit (HPU) 103, and an indoor unit (IU) 104. According to the actual requirements, in air conditioning system 100, the number of the aforementioned units can be one or more. Particularly, there can be more than one indoor unit 104 and more than one humidity processing unit 103.

High temperature cooling unit 101 provides coolant with a first temperature into indoor unit 104. Here, the coolant can be water. After heat exchange in indoor unit 104, the temperature of the coolant becomes a second temperature and the coolant flows out of indoor unit 104 back to high temperature cooling unit 101.

Low temperature cooling unit 102 provides coolant with a third temperature into humidity processing unit 103. After heat exchange in humidity processing unit 103, the temperature of the coolant becomes a fourth temperature and the coolant flows out of humidity processing unit 103 back to low temperature cooling unit 102. Low temperature cooling unit 102 can be a water-to-water heat pump (WWHP).

In air conditioning system 100, it is indoor unit 104 that directly controls the temperature of the indoor environment. Its main components include fan coils. Indoor unit 104 realizes heat exchange by driving air though coils with coolant, so as to adjust temperature. It is humidity processing unit 103 in air conditioning system 100 that controls the humidity of the indoor environment. Humidity control is realized by driving fresh air from outdoors through coils in humidity processing unit 103. It can be readily understood that return air from the indoor, or the combination of fresh air and return air can also be utilized here.

As illustrated by FIG. 1, part of the coolant flowing out of indoor unit 104 is divided to the low temperature cooling unit 102 before reaching high temperature cooling unit. After heat exchange in low temperature cooling unit 102, to be exactly the condenser, coolant with a fifth temperature flow back into high temperature cooling unit 101.

Air conditioning system 100 can work both in a cooling mode and a heating mode. In the cooling mode, the second temperature is higher than the first temperature, the fourth temperature is higher than the third temperature, and the fifth temperature is higher than the second temperature. In the heating mode, the second temperature is lower than the first temperature, the fourth temperature is lower than the third temperature, and the fifth temperature is lower than the second temperature.

Air conditioning system 100 can further comprise control unit (CU) 105. It communicates with high temperature cooling unit 101, low temperature cooling unit 102, humidity processing unit 103, and indoor unit 104. According to temperature requirement sent from indoor unit 104, control unit 105 sends instructions to high temperature cooling unit 101 to adjust the flow rate of the coolant through it and the first temperature, and according to humidity requirement from humidity processing unit 103, control unit 105 sends instructions to low temperature cooling unit 102 to adjust the flow rate of the coolant through it and the third temperature. Therefore, the whole air conditioning system control process comprises at least three steps:

(1) controlling the flow rate of the coolant with the first temperature into the indoor unit and the first temperature, so as to adjust the indoor temperature;

(2) controlling the flow rate of the coolant with the third temperature into the humidity processing unit and the third temperature, so as to adjust the indoor humidity; and (3) controlling the flow rate of the coolant with the second temperature divided into the low temperature cooling.

Figure 2:
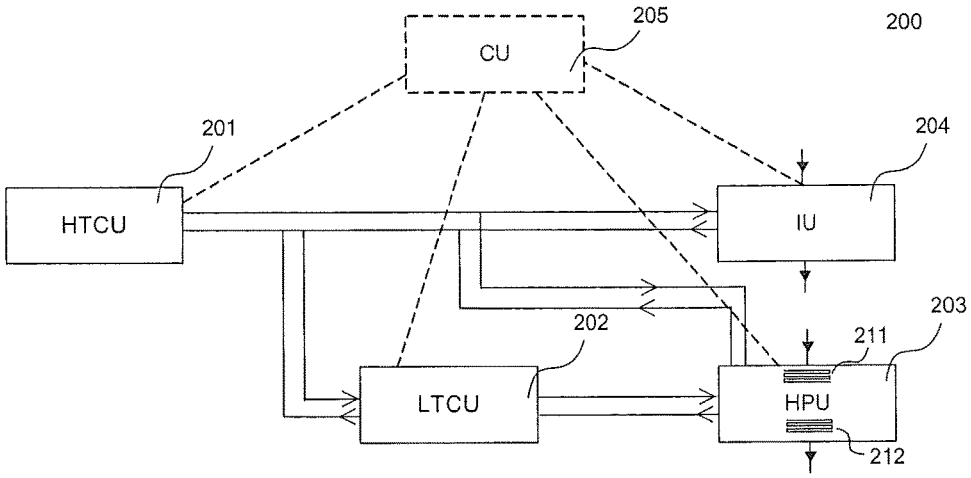
FIG. 2 illustrates another temperature and humidity independent control air conditioning system according to the present invention.

FIG. 2 illustrates another embodiment of the temperature and humidity independent control air conditioning system of the present invention. Air conditioning system 200 comprises high temperature cooling unit 201, low temperature cooling unit 202, humidity processing unit 203, and indoor unit 204. Being different from air conditioning system 100 in FIG. 1, in air conditioning system 200, the coolant with the first temperature is further divided into humidity processing unit 203. After heat exchange in humidity processing unit 203, the temperature of the coolant becomes the sixth temperature, and the coolant flows back to high temperature cooling unit 201. In cooling mode, the sixth temperature is higher than the first temperature, while in heating mode, the sixth temperature is lower than the first temperature.

In the embodiment of air conditioning system 200 as illustrated in FIG. 2, humidity processing unit 203 has a first coil 211 and a second coil 212. The coolant with the first temperature flows into the inlet of the first coil 211, and the coolant with the sixth temperature flows out of the outlet of the first coil 211; the coolant with the third temperature flows into the inlet of the second coil 212, and the coolant with the fourth temperature flows out of the outlet of the second coil 212. In another embodiment of the present invention, the first coil 211 is close to the inlet of fresh air or return air, the second coil 212 is subsequent to the first coil 211 along the flow direction of the fresh air or return air. According to this arrangement, fresh air or return air are subjected to two processes by the coil with first temperature and that with the third temperature in series. The efficiency of the system is further enhanced by this arrangement. As an example, system can shut down the low temperature cooling unit to save energy and improve efficiency if, after the first coil 211, the humidity of fresh air or return air has met the predetermined criterion.

Air conditioning system 200 as illustrated by FIG. 2 can also has control unit 205, which communicates with high temperature cooling unit 201, low temperature cooling unit 202, humidity processing unit 203 and indoor unit 204. According to temperature requirement sent from indoor unit 204 and humidity requirement sent from humidity processing unit 203, control unit 205 sends instructions to high temperature cooling unit 201 to adjust the flow rate of the coolant through it and the first temperature, and according to humidity requirement from humidity processing unit 203, control unit 105 sends instructions to low temperature cooling unit 202 to adjust the flow rate of the coolant through it and the third temperature.

Figure 3:
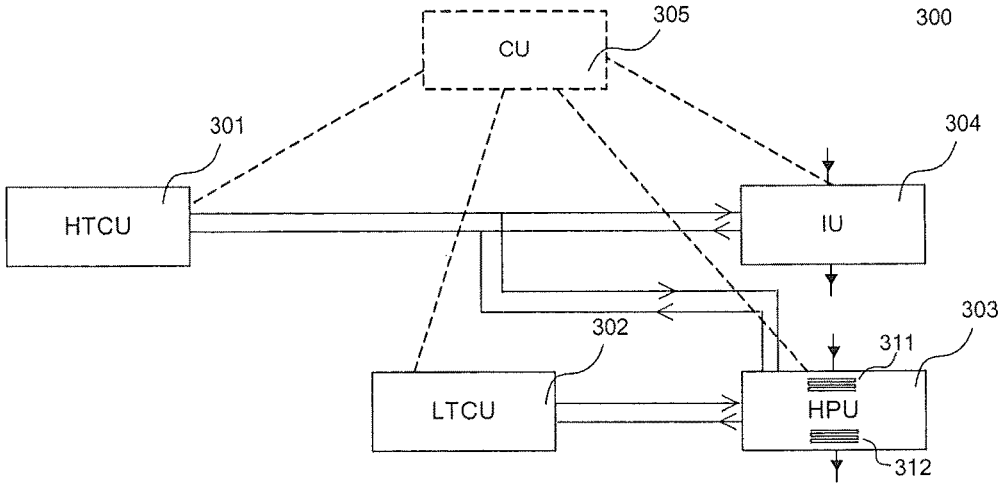
FIG. 3 illustrates a further temperature and humidity independent control air conditioning system according to the present invention.

FIG. 3 illustrates a further embodiment of a temperature and humidity independent control air conditioning system of the present invention. Air conditioning system 300 comprises high temperature cooling unit 301, low temperature cooling unit 302, humidity processing unit 303 and indoor unit 304.

High temperature cooling unit 301 provides coolant with first temperature, and part of the coolant flows into indoor unit 304. After heat exchange in indoor unit 304, the temperature of the coolant becomes a second temperature, and the coolant flows back to high temperature cooling unit 301. The other part of the coolant with the first temperature is divided into humidity processing unit 303. After heat exchange in humidity processing unit 303, the temperature of the coolant becomes the sixth temperature and the coolant flows back into high temperature cooling unit 301.

The coolant with the third temperature provided by low temperature cooling unit 302 flows into humidity processing unit 303. After heat exchange in humidity processing unit 303, the temperature of the coolant becomes the fourth temperature and the coolant flows back into low temperature cooling unit 302. Here, low temperature cooling unit 302 can be air-cooled chiller.

Humidity processing unit 303 comprises a first coil 311 and a second coil 312. The coolant with the first temperature flows into the inlet of the first coil 311, and the coolant with the sixth temperature flows out of the outlet of the first coil 311. The coolant with the third temperature flows into the inlet of the second coil 312, and the coolant with the fourth temperature flows out of the outlet of the second coil 312.

Air conditioning system 300 illustrated in FIG. 3 can work in either a cooling mode or a heating mode. In the cooling mode, the second temperature is higher than the first temperature, the fourth temperature is higher than the third temperature, and the sixth temperature is higher than the first temperature. In the heating mode, the second temperature is lower than the first temperature, the fourth temperature is lower than the third temperature, and the sixth temperature is lower than the first temperature.

Temperature and humidity independent control air conditioning system 300 further comprises control unit 305. It communicates with high temperature cooling unit 301, low temperature cooling unit 302, humidity processing unit 303, and indoor unit 304. According to temperature requirement sent from indoor unit 304 and humidity requirement sent from humidity processing unit 303, control unit 305 sends instructions to high temperature cooling unit 301 to adjust the flow rate of the coolant through it and the first temperature, and according to humidity requirement from humidity processing unit 303, control unit 305 sends instructions to low temperature cooling unit 302 to adjust the flow rate of the coolant through it and the third temperature. Therefore, the whole air conditioning system control process comprises at least three steps: (1) controlling the flow rate of the coolant with first temperature into the indoor unit and the first temperature, so as to adjust the indoor temperature; (2) controlling the flow rate of the coolant with third temperature into the humidity processing unit and the third temperature, so as to adjust the indoor humidity; and (3) controlling the flow rate of the coolant with the first temperature divided into the humidity processing unit.

Control processes described herein may be implemented by various approaches depending at least in part upon applications according to particular features or examples. For example, such processes may be implemented in hardware, firmware, software, or any combinations thereof. In a hardware implementation, for example, a process may be implemented within one or more application specific integrated circuits (ASICs), digital signal processors (DSPs), digital signal processing devices (DSPDs), programmable logic devices (PLDs), field programmable gate arrays (FPGAs), processors, controllers, microcontrollers, microprocessors, electronic devices, or other devices units designed to perform functions such as those described herein or any combinations thereof.

Likewise, in some embodiments, processes may be implemented with modules that perform functions described herein or any combination thereof. Any machine readable medium tangibly embodying instructions may be used in implementing such methodologies, for example. In an embodiment, for example, software or code may be stored in a memory and executed by a processing unit. Memory may be implemented within a processing unit and/or external to the processing unit. As used herein the term "memory" refers to any type of long term, short term, volatile, non-volatile, or other memory and is not to be limited to any particular type of memory or number of memories, or type of media upon which memory is stored.

A storage media may comprise any available media that may be accessed by a computer, computing platform, computing device, or the like. By way of example but not limitation, a computer-readable medium may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer, computing platform or computing device.

While there has been illustrated or described what are presently considered to be example features, it will be understood by those skilled in the art that various other modifications may be made without departing from claimed subject matter. Therefore, it is intended that claimed subject matter not be limited to particular examples disclosed, but that such claimed subject matter may also include all aspects falling within the scope of appended claims.

The invention claimed is:

1. A temperature and humidity independent control air conditioning system, comprising:

a high temperature cooling unit, a low temperature cooling unit, a humidity processing unit, and an indoor unit, wherein coolant with a first temperature provided by the high temperature cooling unit, after flowing into the indoor unit, becomes coolant with a second temperature, which flows back into the high temperature cooling unit;

coolant with a third temperature provided by the low temperature cooling unit, after flowing into the humidity processing unit, becomes coolant with a fourth temperature, which flows back into the low temperature cooling unit; and wherein a portion of the coolant with the second temperature is divided away from flowing back into the high temperature cooling unit and into the low temperature cooling unit to become coolant with a fifth temperature, which flows back into the high temperature cooling unit.

2. The temperature and humidity independent control air conditioning system according to claim 1, wherein the coolant with the first temperature is divided into the humidity processing unit to become coolant with a sixth temperature, which flows back into the high temperature cooling unit.

3. The temperature and humidity independent control air conditioning system according to claim 1, wherein the coolant with the second temperature is divided into a condenser of the low temperature cooling unit to become the coolant with the fifth temperature, which flows out of the condenser of the low temperature cooling unit.

4. The temperature and humidity independent control air conditioning system according to claim 1, wherein the low temperature cooling unit is a water-to-water heat pump.

5. The temperature and humidity independent control air conditioning system according to claim 2, wherein the humidity processing unit comprises a first coil and a second coil, and the coolant with the first temperature flows into the inlet of the first coil; the coolant with the sixth temperature flows out of the outlet of the first coil; the coolant with the third temperature flows into the inlet of the second coil; the coolant with the fourth temperature flows out of the outlet of the second coil.

6. The temperature and humidity independent control air conditioning system according to claim 5, the second coil is arranged downstream from the first coil in the flow direction of fresh air or return air which flows into the humidity processing unit.

7. The temperature and humidity independent control air conditioning system according to claim 1, wherein in a cooling mode, the second temperature is higher than the first temperature, the fourth temperature is higher than the third temperature, and the fifth temperature is higher than the second temperature.

8. The temperature and humidity independent control air conditioning system according to claim 2, wherein in a cooling mode, the second temperature is higher than the first temperature, the fourth temperature is higher than the third temperature, the fifth temperature is higher than the second temperature, and the sixth temperature is higher than the first temperature.

9. A method of controlling a temperature and humidity independent control air conditioning system according to claim 1, comprising:

controlling the flow rate of the coolant with the first temperature into the indoor unit and the first temperature, so as to adjust the indoor temperature;

controlling the flow rate of the coolant with the third temperature into the humidity processing unit and the third temperature, so as to adjust an indoor humidity; and controlling the flow rate of the coolant with the second temperature divided into the low temperature cooling.

10. A temperature and humidity independent control air conditioning system, comprising:

a high temperature cooling unit, a low temperature cooling unit, a humidity processing unit, and an indoor unit, wherein coolant with a first temperature provided by the high temperature cooling unit, after flowing into the indoor unit, becomes coolant with a second temperature, which flows back into the high temperature cooling unit;

coolant with a third temperature provided by the low temperature cooling unit, after flowing into the humidity processing unit, becomes coolant with a fourth temperature, which flows back into the low temperature cooling unit; and the coolant with the second temperature is divided into the low temperature cooling unit to become coolant with a fifth temperature, which flows back into the high temperature cooling unit;

wherein the temperature and humidity independent control air conditioning system further comprises a control unit, which communicates with the high temperature cooling unit, the low temperature cooling unit, the humidity processing unit, and the indoor unit, and the control unit regulates the flow rate of the coolant provided by the high temperature cooling unit and the first temperature according to the indoor temperature requirement, and regulates the flow rate of the coolant provided by the low temperature cooling unit and the third temperature according to an indoor humidity requirement.

11. A temperature and humidity independent control air conditioning system, comprising:

a high temperature cooling unit, a low temperature cooling unit, a humidity processing unit, and an indoor unit, wherein coolant with a first temperature provided by the high temperature cooling unit, after flowing into the indoor unit, becomes coolant with a second temperature, which flows back into the high temperature cooling unit;

coolant with a third temperature provided by the low temperature cooling unit, after flowing into the humidity processing unit, becomes coolant with a fourth temperature, which flows back into the low temperature cooling unit; and the coolant with the second temperature is divided into the low temperature cooling unit to become coolant with a fifth temperature, which flows back into the high temperature cooling unit;

wherein the coolant with the first temperature is divided into the humidity processing unit to become coolant with a sixth temperature, which flows back into the high temperature cooling unit;

wherein the temperature and humidity independent control air conditioning system further comprises a control unit, which communicates with the high temperature cooling unit, the low temperature cooling unit, the humidity processing unit, and the indoor unit, and the control unit regulates the flow rate of the coolant provided by the high temperature cooling unit and the first temperature according to both the indoor temperature requirement and an indoor humidity requirement, and regulates the flow rate of the coolant provided by the low temperature cooling unit and the third temperature according to the indoor humidity requirement.

12. A temperature and humidity independent control air conditioning system, comprising:

a high temperature cooling unit, a low temperature cooling unit, a humidity processing unit, and an indoor unit, wherein coolant with a first temperature provided by the high temperature cooling unit, after flowing into the indoor unit, becomes coolant with a second temperature, which flows back into the high temperature cooling unit;

coolant with a third temperature provided by the low temperature cooling unit, after flowing into the humidity processing unit, becomes coolant with a fourth temperature, which flows back into the low temperature cooling unit; and the coolant with the second temperature is divided into the low temperature cooling unit to become coolant with a fifth temperature, which flows back into the high temperature cooling unit;

wherein in a heating mode, the second temperature is lower than the first temperature, the fourth temperature is lower than the third temperature, and the fifth temperature is lower than the second temperature.

13. A temperature and humidity independent control air conditioning system, comprising:

a high temperature cooling unit, a low temperature cooling unit, a humidity processing unit, and an indoor unit, wherein coolant with a first temperature provided by the high temperature cooling unit, after flowing into the indoor unit, becomes coolant with a second temperature, which flows back into the high temperature cooling unit;

coolant with a third temperature provided by the low temperature cooling unit, after flowing into the humidity processing unit, becomes coolant with a fourth temperature, which flows back into the low temperature cooling unit; and the coolant with the second temperature is divided into the low temperature cooling unit to become coolant with a fifth temperature, which flows back into the high temperature cooling unit;

wherein the coolant with the first temperature is divided into the humidity processing unit to become coolant with a sixth temperature, which flows back into the high temperature cooling unit;

wherein in a heating mode, the second temperature is lower than the first temperature, the fourth temperature is lower than the third temperature, the fifth temperature is lower than the second temperature, and the sixth temperature is lower than the first temperature.

* * * * *